United States Patent [19]

Cetrelli et al.

[11] Patent Number: 4,909,028

[45] Date of Patent: Mar. 20, 1990

[54] PRESSURE RELIEF DEVICE

[75] Inventors: Renzo Cetrelli; Nils Endahl, both of Finspong, Sweden

[73] Assignee: ABB Stal AB, Finspong, Sweden

[21] Appl. No.: 325,820

[22] Filed: Mar. 3, 1989

[30] Foreign Application Priority Data

Mar. 4, 1988 [SE] Sweden ..... 88007760

[51] Int. Cl.[4] ..... F02G 3/00; F16P 7/00

[52] U.S. Cl. ..... 60/39.1; 60/39.25; 60/39.464; 122/4 D; 122/504

[58] Field of Search ..... 122/4 D, 504, 504.2; 60/39.02, 39.1, 39.25, 39.464

[56] References Cited

U.S. PATENT DOCUMENTS 4,306,411 12/1981 Zoll .

4,498,285 2/1985 Kreij .

4,838,209 6/1989 Hjalmarsson ..... 122/4 D

*Primary Examiner*—Edward G. Favors

*Attorney, Agent, or Firm*—Pollock, Vande Sande & Priddy

[57] ABSTRACT

The invention relates to a pressure-relief device in a PFBC power plant with a combustor (12) enclosed in a pressure vessel (10). The device is intended to limit the pressure difference between the combustor (12) and the surrounding space (22) in the pressure vessel (10) and to initiate pressure relief of the pressure vessel (10) out into the atmosphere. Via a conduit (54) with a rupture disc (56), the combustor (12) communicates with one or more blow-off valves (42). If the rupture disc (56) bursts, a sensor (62) indicates this and effects opening of the blow-off valve (42) via signal processing and operating equipment (64). Between the rupture disc (56) and the combustor (12) a perforated diaphragm (60) is provided. In the space between this diaphragm and the rupture disc (56) a layer of particulate, heat-insulating material (58) is provided, which restricts the heating of the rupture disc (56).

5 Claims, 3 Drawing Sheets

PRESSURE RELIEF DEVICE

The invention relates to a pressure relief device in a PFBC power plant with a combustor enclosed within a pressure vessel. The object of the invention is to limit the pressure difference between the combustor and the surrounding space in the pressure vessel and to initiate pressure relief of the pressure vessel out into the atmosphere. The combustor contains a fluidizing bed with tubes for steam generation and may, for example, be subjected to a pressure increase because of a tube rupture.

BACKGROUND ART

A tube rupture resulting in water flowing out in a combustor for combustion in a fluidized bed entails problems of a completely different dimension and difficulty than a tube rupture in an ordinary boiler, in which steam flowing out is evacuated with the flue gases to the chimney. A fluidized bed contains a large quantity of heat and a tube rupture involving water flowing out in the bed results in a violet steam generation. A gas turbine connected to the combustor limits the outflow of gas from the combustor so that a pressure increase may arise and lead to an impermissible pressure difference between the combustor and the surrounding space. From the point of view of safety, it is important to limit a pressure in the combustor, arising as a result of a tube rupture, by means of a pressure relief device. Because the combustor is enclosed in a pressure vessel and the pressure difference between the combustor and the pressure vessel varies with the load, special problems arise which must be taken into consideration when designing the relief system.

SUMMARY OF THE INVENTION

According to the invention, the combustor is connected to a conduit having blow-off valves through which gas in the combustor can be blown off into the atmosphere. This conduit includes a rupture disc adapted to rupture at a defined pressure difference between the combustor and the surrounding space in the pressure vessel. In order to obtain a well-defined rupture pressure, thermal insulating material is provided between the combustor and the rupture disc, so that the latter can be maintained at a well-defined temperature and rupture at the intended pressure difference be obtained. In view of the risk of damage on valves or clogging of the same, a particulate, light, smooth, heat-insulating material is used. In order to obtain a good insulation between the interior of the combustor and the disc with a small thickness of the insulating material, a wide range of sizes of particles must be used. The risk of such material entailing problems upon disc rupture is small. In the event of rupture of a rupture disc, the blow-off valve or the valves located adjacent to the above-mentioned conduit must be rapidly opened. Associated with the rupture disc or the conduit downstream of the rupture disc there is a device indicating rupture disc rupture and causing opening of the blow-off valve via the signal processing and operating equipment. The further characteristics of the invention will become apparent from the appended claims.

BRIEF DESCRIPTION OF THE DRAWING

The invention will be described in greater detail with reference to the accompanying drawing, wherein FIG. 1 schematically shows a PFBC power plant with a pressure relief device.

DESCRIPTION OF THE PREFERRED EMBODIMENT

Figure 1:
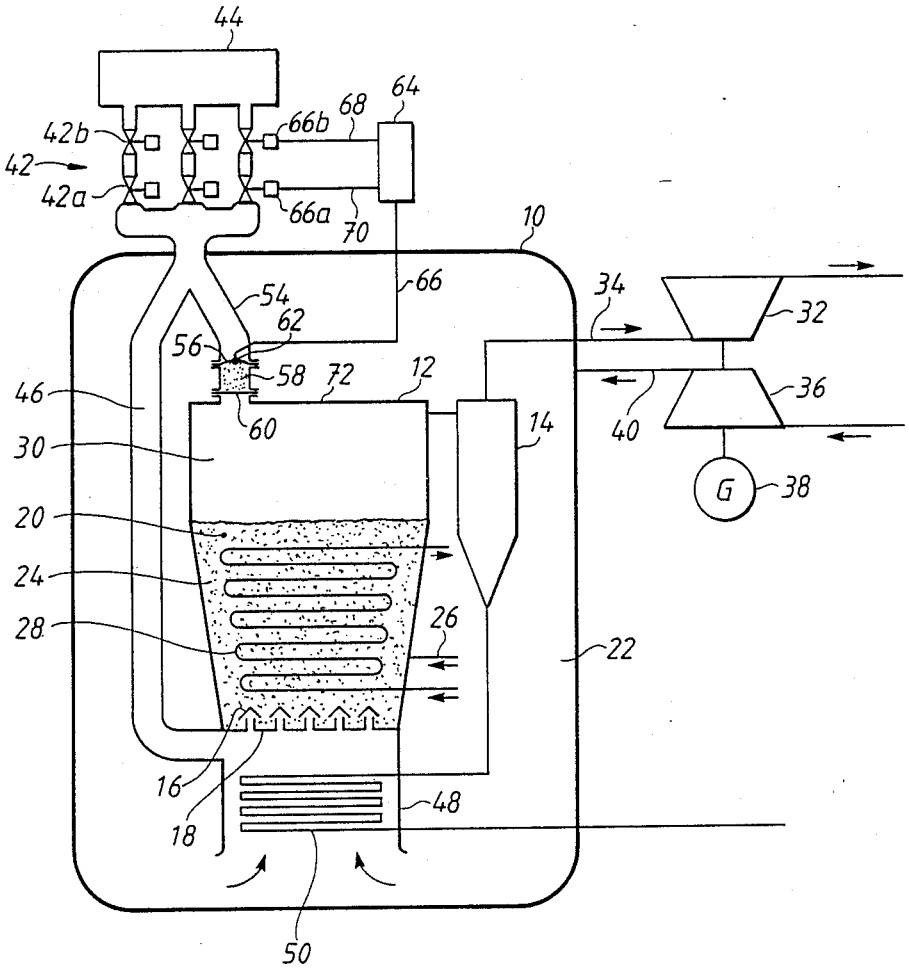

In the figures, 10 designates a pressure vessel, 12 a combustor and 14 a cleaning plant for separation of dust from the combustion gases, the combustor and cleaning plant being located inside the pressure vessel. The cleaning plant 14 is symbolized by a cyclone. The combustor 12 has an air-distributing bottom 18 with nozzles 16, through which the combustion space 20 is supplied with compressed combustion air from the space 22 between the pressure vessel 10 and the combustor 12. This air fluidizes a bed 24 of particulate material which partly consists of a sulphur absorbent and burns a fuel supplied to the bed 24 through a conduit 26. The combustor 12 has tubes 28 therein which cool the bed 24 and generate steam for a steam turbine (not shown). The combustion gases are collected in the freeboard 30 above the bed 24 in the combustion space 20, are cleaned in the cleaning plant 14 and supplied to the gas turbine 32 via the conduit 34. The turbine drives a compressor 36 and a generator 38 which supplies an electricity grid (not shown) with current. The air compressed in the compressor 36 is supplied to the space 22 via the conduit 40.

Outside of the pressure vessel 10 there are three valve groups 42 which have two series-connected valves **42*a* and 42*b* for blowing off air from the space 22 in case of certain types of operational disturbances. Downstream of the valve groups 42 there is a noise suppressor 44. The valve groups 42 are connected through the conduit 46 to the duct 48 downstream of the pressure reducing dust discharge device 50 is formed as a cooler and receives cooling air from the space 22. The valve groups 42 are also connected to the freeboard 30 of the combustor 12 through the conduit 54, in which there is a rupture disc 56. The rupture disc 56 is protected from the heat in the combustor 12 by particulate heat-insulating material 58 which is supported by a diaphragm which may be perforated or by a net 60. The heat-insulating material consists of a granulated material known under the trade name VERMIKULIT®, or an equivalent material. The rupture disc 56, the diaphragm or net are to be designed in such a way that they do not significantly restrict the gas flow. Means for catching a ruptured disc 56 are suitably arranged upstream of the valves 42. Associated with the rupture disc 56 is a sensor 62 indicating rupture. This sensor 62 and the operating devices 66*a* and 66*b* of the valves 42*a* and 42*b* are connected to signal and operating equipment 64 by means of conduits 66 and 68 and 70, respectively. Upon rupture of the rupture disc 56, the operating equipment 64 attends to the valves 42*a* and 42*b*** being opened.

Figure 2:
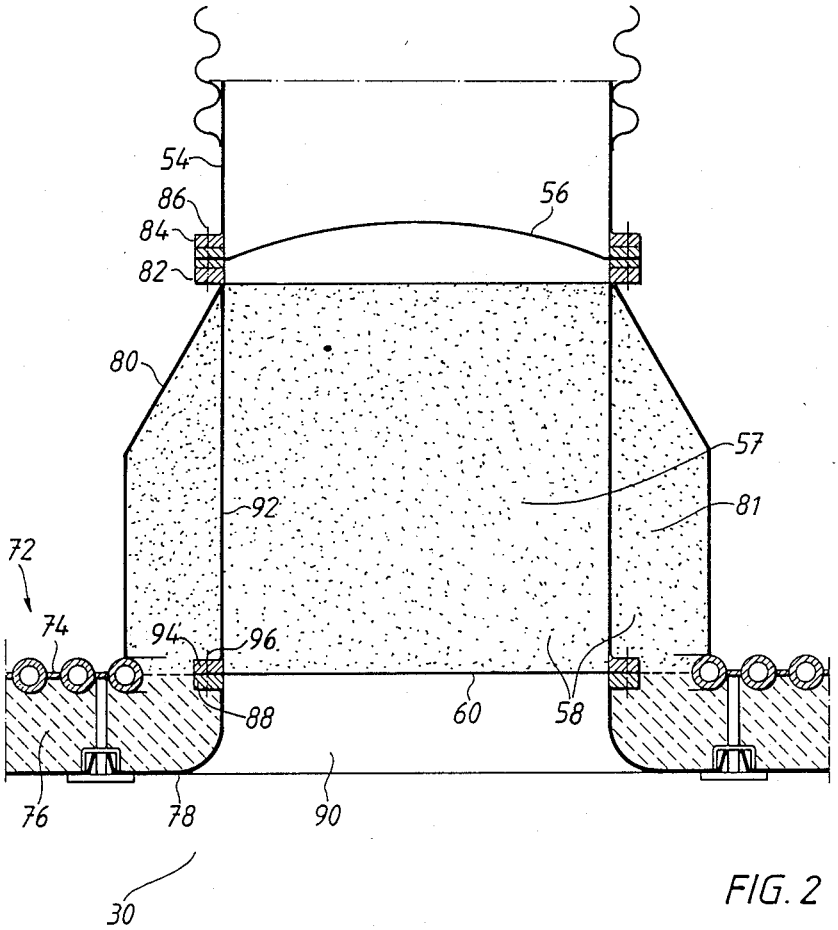
FIGS. 2 and 3 show details of the pressure relief device.
Figure 3:
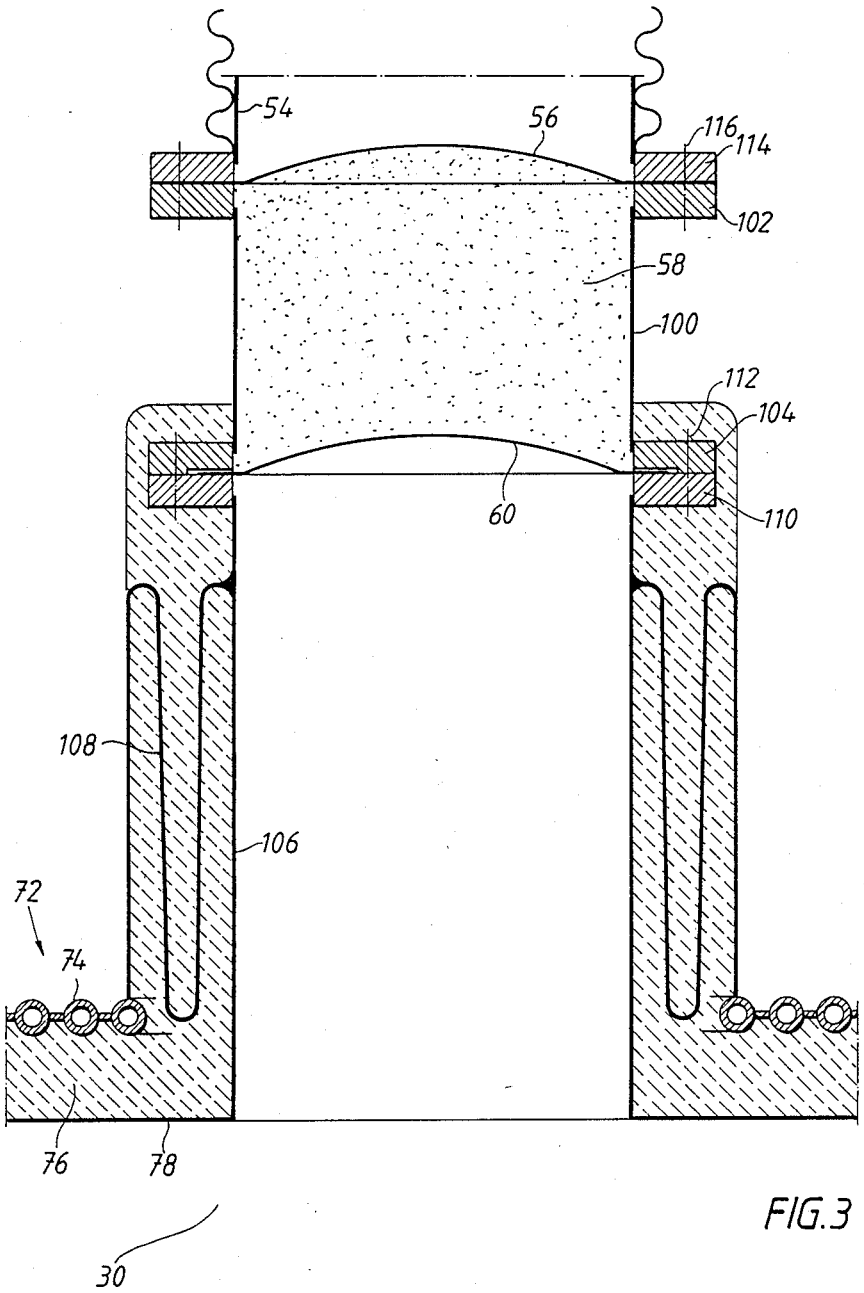

FIGS. 2 and 3 show alternative embodiments of the pressure relief device and its connection to the upper wall 72 of the combustor. The wall consists of a cooled gas-tight panel 74 and an internal insulation of insulating material 76 and protecting plates 78.

In the embodiment according to FIG. 2, a sleeve 80 with a larger diameter than the conduit 54 is gas-tightly connected to the wall 74. The sleeve 80, the conduit 54 and the rupture disc 56 are interconnected by means of the flanges 82 and 84 and the bolted joint 86. A protecting plate 78 is connected to an opening 90. A sleeve 92 projects into the sleeve 80 and is joined to the plate 78 by means of the flanges 88 and 94 and the bolted joint 96. The perforated diaphragm 60 covers the opening 90 and is retained between the flanges 88 and 94. The space in the sleeve 92 between the diaphragm 60 and the rupture disc 56 and the annular space between the sleeve 80 and the sleeve 92 are filled with the heat-insulating particulate material 58. Also the space 81 between the sleeve 80 and the sleeve 92 contains particulate heat-insulating material 58. At a temperature of 850°-900° C. in the freeboard 30, the temperature of the rupture disc 56 can be maintained at 300°-350° C.

In the embodiment according to FIG. 3, a sleeve 100 with the flanges 102 and 104 is inserted between the conduit 54 and a sleeve 106 which is connected to a protecting plate 78. The sleeve 106 is gas-tightly joined to the bellows 108 and the cooled panel 74. The sleeve 100, the sleeve 106 and the perforated diaphragm 60 are joined together by means of the flanges 104 and 110 and the bolted joint 112. The tube 54, the sleeve 100 and the rupture disc 56 are joined together by the flanges 102 and 114 and the bolted joint 116.

We claim:

1. A pressure relief device in a PFBC power plant with a combustor (12) enclosed within a pressure vessel (10) for limitation of the pressure difference between the combustor (12) and the surrounding space (22) in the pressure vessel (10), characterized in that the combustor (12) communicates, via a conduit (54), with at least one blow-off valve (42) for blow-off of gas from the combustor (12) into the atmosphere, .

said conduit (54) includes a perforated diaphragm or a net (60) and, downstream of the diaphragm or net, a rupture disc (56), a space formed by the diaphragm or net (60) and the rupture disc (56) is completely or partially filled with a particulate, light, smooth heat-insulating material (58), and that it comprises a sensor (62) indicating rupture of the rupture disc (56) and producing an operating signal which opens the blowoff valve (42).

2. A device according to claim 1, characterized in that the openings in the perforated diaphragm or in the net (60) are smaller than 2 mm, preferably smaller than 0.1 mm.

3. A device according to claim 1, characterized in that between said conduit (54) and the blow-off valve (42) there is an open communication with the space (22) between the pressure vessel (10) and the combustor (12).

4. A device according to claim 1, characterized in that the blow-off conduit (54), at the connection to the combustor (12), is provided with an internal insulation (76) and is gas-tightly connected to the gas-tight wall (74) of the combustor (12) by means of a bellows (108).

5. A device according to claim 1, characterized in that the blow-off conduit (54) with an enlarged portion (80) is directly connec to the gas-tight wall (74) of the combustor (12), a sleeve (92) connected to an internal insulation (76, 78) in the combustor (12) projects into the enlarged portion (80) of the blow-off conduit (54), and that an annular space (81), formed by the sleeve (92) and the enlarged portion (80) of the blow-off conduit (54), is completely or partially filled with a heat-insulating material (58).

* * * * *